US009045832B2

(12) United States Patent
Murazumi et al.

(10) Patent No.: US 9,045,832 B2
(45) Date of Patent: Jun. 2, 2015

(54) MANUFACTURING METHOD OF TIMEPIECE PART AND TIMEPIECE PART

(75) Inventors: Takuya Murazumi, Chiba (JP); Akiko Araki, Chiba (JP); Takashi Niwa, Chiba (JP); Matsuo Kishi, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 663 days.

(21) Appl. No.: 13/374,138

(22) Filed: Dec. 13, 2011

(65) Prior Publication Data

US 2012/0155228 A1 Jun. 21, 2012

(30) Foreign Application Priority Data

Dec. 16, 2010 (JP) ..... 2010-281040

(51) Int. Cl.

| | |
|---|---|
| ***G04B 37/00*** | (2006.01) |
| ***C25D 5/54*** | (2006.01) |
| ***C23F 1/00*** | (2006.01) |
| ***C23F 3/06*** | (2006.01) |
| ***C22F 1/18*** | (2006.01) |
| ***C23F 1/26*** | (2006.01) |
| ***G04B 13/02*** | (2006.01) |
| ***G04B 17/06*** | (2006.01) |
| ***G04B 19/04*** | (2006.01) |
| ***G04B 19/12*** | (2006.01) |
| ***G04B 29/02*** | (2006.01) |
| ***C25D 11/26*** | (2006.01) |

(52) U.S. Cl.

CPC . *C23F 3/06* (2013.01); *C22F 1/183* (2013.01); *C23F 1/26* (2013.01); *G04B 13/02* (2013.01); *G04B 17/063* (2013.01); *G04B 19/042* (2013.01); *G04B 19/12* (2013.01); *G04B 29/027* (2013.01); *C25D 11/26* (2013.01)

(58) Field of Classification Search

None

See application file for complete search history.

(56) References Cited

U.S. PATENT DOCUMENTS

| | | | | |
|---|---|---|---|---|
| 5,658,403 | A * | 8/1997 | Kimura | 148/671 |
| 6,596,150 | B2 * | 7/2003 | Nishino et al. | 205/153 |
| 6,602,620 | B1 * | 8/2003 | Kikitsu et al. | 428/842.2 |
| 2002/0153253 | A1 * | 10/2002 | Nishino et al. | 205/50 |
| 2007/0068605 | A1 * | 3/2007 | Statnikov | 148/558 |
| 2012/0171427 | A1 * | 7/2012 | Kita et al. | 428/156 |

FOREIGN PATENT DOCUMENTS

JP 11100627 * 4/1999

OTHER PUBLICATIONS

JP07-043478_MT. Feb. 1995.*

* cited by examiner

*Primary Examiner* — Vera Katz

(74) *Attorney, Agent, or Firm* — Adam & Wilks

(57) ABSTRACT

A timepiece part, such as a balance staff, an oscillating weight or a dial, is made of polycrystalline material having a plurality of crystals each having a size of 0.7 μm or more and 3 mm or less. The crystals at a surface of the timepiece part have mirror-finished surfaces, and the surfaces may be anodized to provide corrosion resistance. The normal directions of the mirror-finished surfaces are different from one another and provide a metallic luster to the timepiece part.

7 Claims, 5 Drawing Sheets

MANUFACTURING METHOD OF TIMEPIECE PART AND TIMEPIECE PART

BACKGROUND OF THE INVENTION

1. Field of the Invention

The present invention relates to a manufacturing method of a timepiece part and the timepiece part.

2. Description of the Related Art

As material of a timepiece part, titanium or titanium alloy (hereinafter, referred to as "titanium or the like") which is lightweight is widely used. By anodizing processing with respect to the timepiece part formed of the titanium or the like after the shape processing, corrosion resistance can be provided. In addition, by adjusting the condition of the anodizing process, various hues can be provided.

In general, it is difficult to provide a metallic luster in the anodizing process with respect to titanium or the like. Thereby, there is a problem in that a timepiece part lacks the high grade sense.

In JP-A-11-100627 (Patent Reference 1), the following technology is described as a manufacturing method of a titanium product or a titanium alloy product. That is, the material of titanium or titanium alloy is heated in a vacuum or an inert gas at a temperature of 900 to 1500° C., and crystal grains including twin crystals of 100 μm or more are precipitated on a portion or the entirety of the surface or the end. In the titanium or the titanium alloy product which is manufactured by the above method, a crystal surface is aligned in slightly different directions with respect to the normal direction of a metal surface, and it is considered that the crystal surface shines brilliantly according to the viewing angle.

However, in order to obtain a sufficient metallic luster in Patent Reference 1, it is necessary to secure a light reflection area of the crystal surface by coarsening the crystal grains to several mm or more in reality. If the invention of Patent Reference 1 is applied to a timepiece part which is a minute part and the crystal grains are coarsened more than the timepiece part, there is a probability that the timepiece part is formed of one grain (is constituted by a monocrystal). In general, since the hardness of polycrystalline material of the titanium or the like is different for each crystal, if the timepiece part is formed for each crystal, the hardness of the timepiece part varies.

SUMMARY OF THE INVENTION

It is an aspect of the present application to provide a manufacturing method of a timepiece part and a timepiece part which has small variation in hardness and a metallic luster.

According to the present application, in a manufacturing method of a timepiece part which is formed of polycrystalline material, the manufacturing method includes a heat treatment process that heat-treats the polycrystalline material and coarsens a plurality of crystals included in the polycrystalline material, and an etching process that etches the polycrystalline material, mirror-finishes the surfaces of each crystal, and makes the normal directions of the surfaces of each crystal to be different from one another.

According to the application, since the crystals are coarsened by the heat treatment process, a metallic luster is provided on the surface of the timepiece part. In addition, in a case where the metallic luster is insufficient due to the fact that coarsening of the crystals is limited for suppressing a variation in the hardness of the timepiece part, the surfaces of each crystal are mirror-finished in the etching process, and the normal directions of the surfaces of each crystal are different from one another. Therefore, a metallic luster which shines brilliantly can be provided on the surface of the timepiece part.

In addition, it is preferable to coarsen a grain diameter of the crystals to 7 μm or more and 3 mm or less in the heat treatment process.

Since the size of the timepiece part is about 70 μm or more and 30 mm or less, the timepiece part is formed over a plurality of crystals (constituting a polycrystal) and variation in the hardness of the timepiece part can be suppressed.

In addition, it is preferable to further include a shape processing process that processes the shape of the timepiece part after the heat treatment process and before the etching process.

If the heat treatment processing process is performed after the shape processing process, bending or the like due to the heat treatment occurs, and the accuracy of the dimensions of the timepiece part is decreased. Moreover, if the shape processing process is performed after the etching process, the metallic luster provided by etching is damaged. Therefore, by performing the shape processing process after the heat treatment process and before the etching process, the accuracy of dimensions of the timepiece part is secured, and it is possible to ensure the external appearance.

In addition, it is preferable to further include an anodic oxidation process that performs anodizing on the surface of the timepiece part after the etching process.

In this case, a metallic luster which shines brilliantly with a specific hue can be provided on the surface of the timepiece part.

In addition, it is preferable to perform the etching process by depositing the polycrystalline material in a solution which includes a fluorinated acid, nitric acid, and a hydrogen peroxide solution.

In this case, the surfaces of each crystal of the polycrystalline material are mirror-finished, and the normal directions of the surfaces of each crystal can be different from one another.

In addition, it is preferable that the timepiece part is an oscillating weight, a main plate, a gear, a balance wheel, a dial, or a pointer.

In this case, a metallic luster which shines brilliantly can be provided on the surface of each timepiece part while suppressing the variation in the hardness of each timepiece part.

On the other hand, according to the present application, in a timepiece part which is formed of polycrystalline material, surfaces of a plurality of crystals contained in the polycrystalline material are mirror-finished and the normal directions of the surfaces are different from one another.

According the application, in a case where the metallic luster is insufficient due to the fact that coarsening of the crystals is limited for suppressing a variation in the hardness of the timepiece part, the surfaces of each crystal are mirror-finished, and the normal directions of the surfaces of each crystal are different from one another. Therefore, a metallic luster which shines brilliantly can be provided on the surface of the timepiece part.

It is preferable that a grain diameter of the crystals is 7 μm or more and 3 mm or less.

Since the size of the timepiece part is about 70 μm or more and 30 mm or less, the timepiece part is formed over a plurality of crystals (constituting a polycrystal) and variation in the hardness of the timepiece part can be suppressed.

In addition, it is preferable that the polycrystalline material is titanium, titanium alloy, or tungsten.

Moreover, an anodizing may be performed on the surfaces.

In this case, a metallic luster which shines brilliantly with a specific hue can be provided on the surface of the timepiece part.

According to the manufacturing method of the present application, the metallic luster is provided on the surface of the timepiece part by coarsening the crystals in the heat treatment process. In addition, in a case where the metallic luster is insufficient due to the fact that coarsening of the crystals is limited for suppressing a variation in the hardness of the timepiece part, the surfaces of each crystal are mirror-finished in the etching process, and the normal directions of the surfaces of each crystal are different from one another. Therefore, a metallic luster which shines brilliantly can be provided on the surface of the timepiece part.

According the timepiece part of the application, in a case where the metallic luster is insufficient due to the fact that coarsening of the crystals is limited for suppressing a variation in the hardness of the timepiece part, the surfaces of each crystal are mirror-finished, and the normal directions of the surfaces of each crystal are different from one another. Therefore, a metallic luster which shines brilliantly can be provided on the surface of the timepiece part.

BRIEF DESCRIPTION OF THE DRAWINGS

FIG. 5A is a state before etching, and FIG. 5B is a state after etching.

DETAILED DESCRIPTION OF THE PREFERRED EMBODIMENTS

Hereinafter, embodiments of the present invention will be described with reference to the accompanying drawings.

(Timepiece)

In general, a mechanical body including a driving portion of a timepiece is referred to as a "movement". A state where a dial and a pointer are mounted on the movement and inserted into a timepiece case to achieve a finished product is referred to as a "complete". In both sides of a main plate which constitutes a substrate of the timepiece, a side on which a glass of the timepiece case is disposed, that is, a side on which the dial is disposed is referred to as a "back side" of the movement, a "glass side", or a "dial side". In both side of the main plate, a side in which a case back of the timepiece case is disposed, that is, the side opposite to the dial is referred to as a "front side" of the movement or a "case back side".

Figure 1:
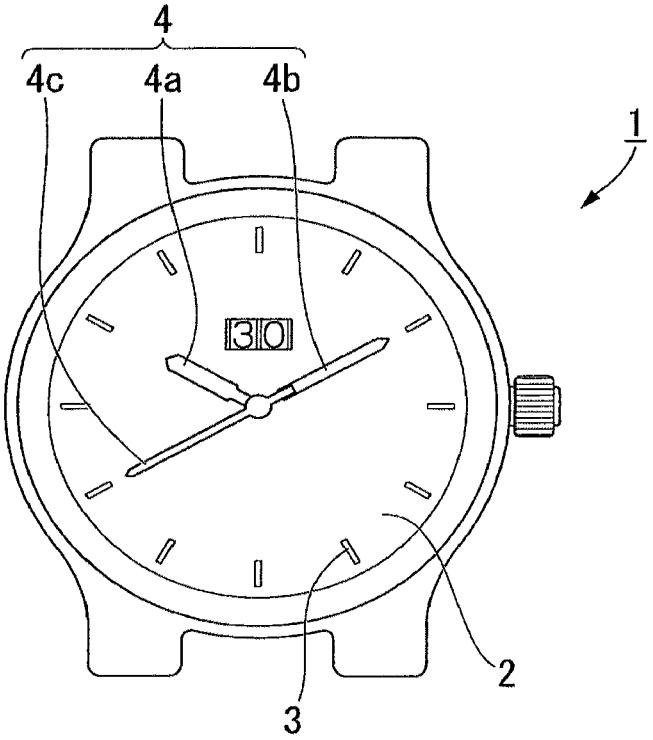
FIG. 1 is a plan view of a back side of a complete.

FIG. 1 is a plan view of the back side of the complete. The complete 1 includes a dial 2 which has a scale 3 or the like indicating information with respect to the time. In addition, a pointer 4 which includes an hour hand 4*a* indicating the hour, a minute hand 4*b* indicating the minute, and a second hand 4*c* indicating the second are provided.

Figure 2:
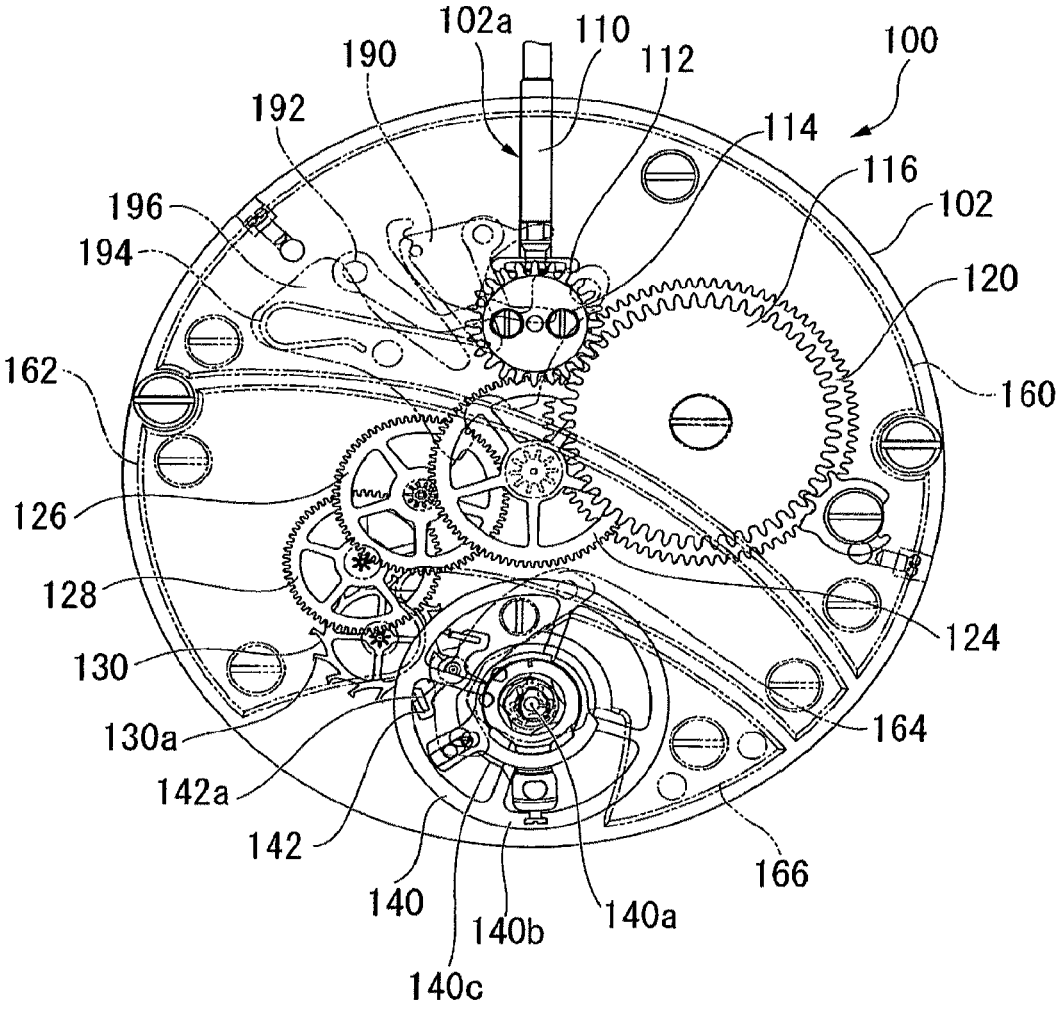
FIG. 2 is a plan view of a front side of a movement.

FIG. 2 is a plan view of the front side of the movement. Moreover, in FIG. 2, for easy understanding of the drawing, illustration of a portion in timepiece parts constituting the movement 100 is omitted. The movement 100 of a mechanical timepiece includes a main plate 102 which constitutes the substrate. A winding stem 110 is rotatably built into a winding stem guide hole 102*a* of the main plate 102. A position of an axial direction of the winding stem 110 is determined by a switching device which includes a setting lever 190, a yoke 192, a yoke spring 194, and a setting lever jumper 196.

In addition, if the winding stem 110 is rotated, a winding pinion 112 is rotated through a rotation of a clutch wheel (not shown). A crown wheel 114 and a ratchet wheel 116 are rotated in order by a rotation of the winding pinion 112, and a mainspring (not shown) which is received in the movement barrel wheel 120 is wound up.

The movement barrel wheel 120 is rotatably supported between the main plate 102 and the barrel bridge 160. A center wheel & pinion 124, a third wheel & pinion 126, a second wheel & pinion 128, and an escape wheel & pinion 130 are rotatably supported between the main plate 102 and a train wheel bridge 162. A pallet fork 142 is rotatably supported between the main plate 102 and a pallet bridge 164.

The movement barrel wheel 120 is rotated by a restoring force of the mainspring, and the center wheel & pinion 124, the third wheel & pinion 126, and the second wheel & pinion 128, and the escape wheel & pinion 130 are rotated in order by the rotation of the movement barrel wheel 120. The movement barrel wheel 120, the center wheel & pinion 124, the third wheel & pinion 126, and the second wheel & pinion 128 constitute a front train wheel. An escapement and regulating device for controlling a rotation of the front train wheel is constituted by the escape wheel & pinion 130, the pallet fork 142, and a balance with hairspring 140. Gear 130*a* is formed on the outer periphery of the escape wheel & pinion 130. The pallet fork 142 includes a pair of pallets 142*a*. The balance with hairspring 140 includes a balance staff 140*a*, a balance wheel 140*b*, and a hairspring 140*c*.

The escape wheel & pinion 130 is temporarily stopped in a state where the pallet 142*a* of one side of the pallet fork 142 is engaged to the gear 130*a* of the escape wheel & pinion 130. Form this state, if the balance with hairspring 140 is rotated by expansion and contraction of the hairspring 140*c*, an impulse pin which is fixed to the balance staff 140*a* swings up the pallet fork 142. Thereby, the pallet 142*a* of the one side of the pallet fork 142 is released from the escape wheel & pinion 130, and the escape wheel & pinion 130 proceeds to a position in which the escape wheel & pinion is engaged to the pallet 142*a* of the other side of the pallet fork 142. Since the balance with hairspring 140 is reciprocatingly rotated by constant period, the escape wheel & pinion 130 can be escaped by constant speed.

If the center wheel & pinion 124 is rotated, a cannon pinion (not shown) is simultaneously rotated based on the rotation, the minute hand 4*b* (refer to FIG. 1) which is mounted on the cannon pinion indicates the "minute". In addition, an hour wheel (not shown) is rotated based on the rotation of the cannon pinion through the rotation of the minute wheel, and the hour hand 4*a* (refer to FIG. 1) which is mounted on the hour wheel indicates the "hour".

Figure 3:
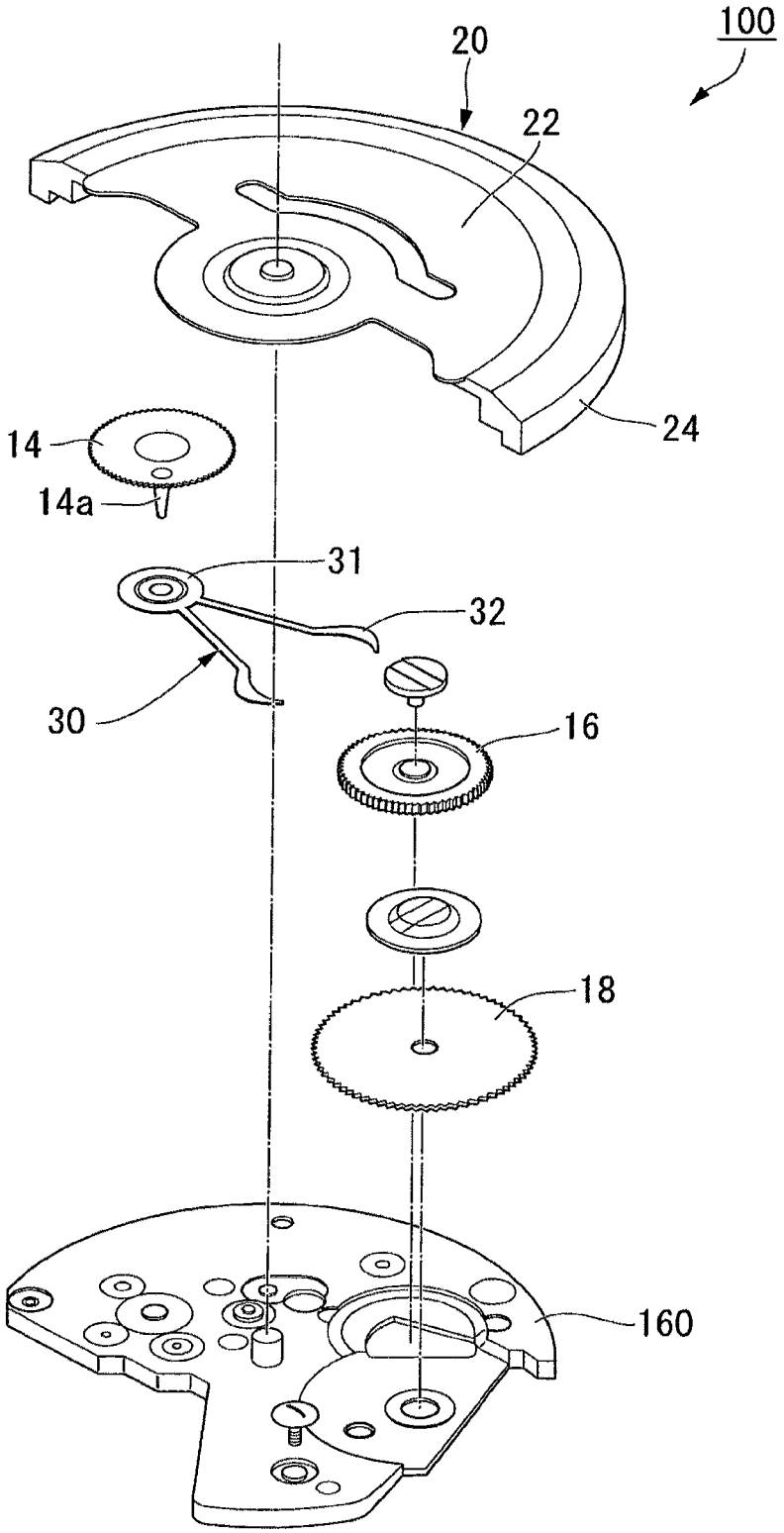
FIG. 3 is an exploded perspective view of the front side of the movement.

FIG. 3 is an exploded perspective view of the front side of the movement. Moreover, in FIG. 3, for easy understanding of the drawing, illustration of a portion in timepiece parts constituting the movement 100 is omitted. The present embodiment is described with the movement 100 of an automatic winding timepiece of a so-called magic lever type as the example. In the front side of the barrel bridge 160, an oscillating weight 20, a winding wheel 14, a reduction wheel 16, and a ratchet wheel 18 are rotatably supported.

The oscillating weight 20 is formed of titanium or the like. The oscillating weight 20 includes a body of the oscillating weight 22 which is formed in a substantial semicircular plate shape, and a weight 24 which is disposed along the outer periphery of the body of the oscillating weight 22. The body of the oscillating weight 22 and the weight 24 are integrally formed, but may be fastened by a fastening member after being separately formed. The oscillating weight 20 can be viewed from the outside through a transparent case back of the timepiece case. Thereby, a metallic luster is provided on the surface of the oscillating weight 20. In addition, anodizing is performed on the surface of the oscillating weight 20 and color is applied, and therefore, the external appearance is secured.

The winding wheel 14 is rotated by the rotation of the oscillating weight 20. In the back side of the winding wheel 14, an eccentric pin 14*a* is installed on a position which is deviated from the rotation center of the winding wheel 14. A pawl lever 30 is rotatably mounted on the eccentric pin 14*a*. The pawl lever 30 includes a ring portion 31 which is inserted from the outside to the eccentric pin 14*a*, and a pair of claws (feeding claw and pulling claw) 32 which is extended from the ring portion 31. A reduction wheel 16 is disposed between a pair of claws 32, and the tips of the pair of claws 32 are engaged to the gear of the outer periphery of the reduction wheel 16. The ratchet wheel 18 is rotated by the rotation of the reduction wheel 16. The ratchet wheel 18 is connected to the movement barrel wheel (not shown) of the back side of the barrel bridge 160.

If the oscillating weight 20 is rotated by the movement of the timepiece, the winding wheel 14 is rotated. Thereby, the pawl lever 30 which is mounted on the eccentric pin 14*a* of the winding wheel 14 approaches to and separates from the reduction wheel 16. When the pawl lever 30 approaches, the feeding pawl presses the gear of the reduction wheel 16, and the pulling claw slides on the gear. When the pawl lever 30 separates, the pulling claw pulls the gear of the reduction wheel 16, and the feeding claw slides on the gear. Thereby, the reduction wheel 16 is rotated in only one direction. If the reduction wheel 16 is rotated, the ratchet wheel 18 and the movement barrel wheel 120 are rotated. Therefore, the mainspring which is received to the movement barrel wheel 120 is automatically wound.

(Manufacturing Method of Timepiece Part)

Next, a manufacturing method of a timepiece part according to an embodiment of the present invention will be described. The manufacturing method of the timepiece part according to the present embodiment can be applied to a timepiece part which is formed of polycrystalline material. Particularly, the present embodiment is effective for the manufacturing of a small timepiece part for which the external appearance is important. For example, the oscillating weight 20 or the main plate 102, the train wheel bridge 162, each gear, the balance wheel 140*b*, the dial 2, the pointer 4 which are described above, and the like can be manufactured. Hereinafter, a case where the timepiece part is manufactured of titanium or titanium alloy (hereinafter, referred to as "titanium or the like") which is a polycrystalline material will be described as the example.

(Heat Treatment Process)

First, a base material (plate material, bar material, or the like) of titanium or the like is prepared. Next, the heat treatment is performed with respect to the base material, and the crystals of titanium or the like are coarsened. If the crystals are coarsened, the areas of the reflective surfaces of the crystal surfaces become large, and a metallic luster is obtained. The crystals of pure titanium are recrystallized at 880° C., and the atomic arrangement is prepared around the nucleus and grown. Thereby, the temperature condition of the heat treatment is given as 900° C. or more and 1500° C. or less. In addition, the holding time is given as 5 hours or more.

Figure 4:
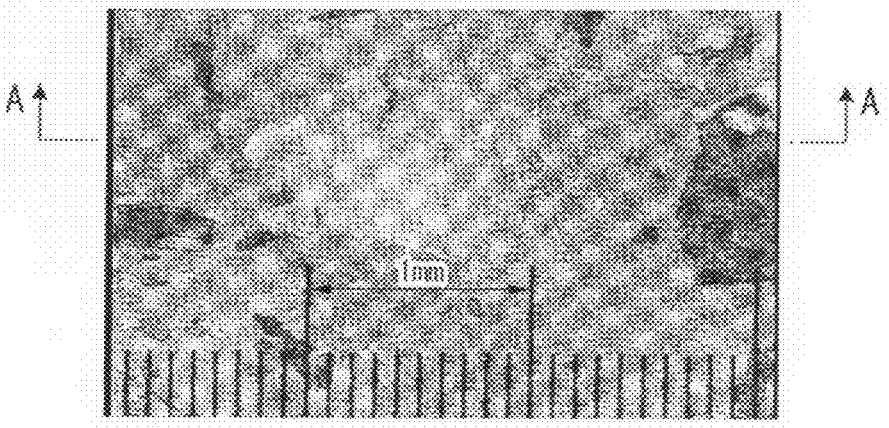
FIG. 4 is appearance of a base material after a heat treatment.

FIG. 4 is appearance of a base material after a heat treatment. In the example of FIG. 4, the crystals are coarsened to be about 1 mm through the heat treatment of 950° C.×5 hours.

As for size of the timepiece part, the smaller one is about 70 μm (for example, a diameter of the balance staff 140*a*, or the like), and the larger one is about 30 mm (for example, the oscillating weight 20 or the main plate 102, the dial 2, and the like). Thereby, if the crystals of titanium or the like are more coarsened than the size of the timepiece part, there is a probability that the timepiece part is formed for each crystal (is constituted by a monocrystal). In general, since the hardness of each crystal is different in the polycrystalline material, if the timepiece part is formed for each crystal, the hardness of the timepiece part varies.

Thus, in the present embodiment, by making the crystal size smaller than the part size, the timepiece part is formed over a plurality of crystals (constituting a polycrystal), and variation in the hardness of the timepiece part is suppressed. It is considered to be preferable that the size of the crystals contained in the timepiece part is about one-tenth of the size of the timepiece part. Since the size of the timepiece part is about 70 μm or more and 30 mm or less, it is preferable that the size of the crystals of titanium or the like is 7 μm or more and 3 mm or less. In the above-described heat treatment process, the crystals of titanium or the like are coarsened so that the size of the crystals is 7 μm or more and 3 mm or less. The crystals can be more coarsened as temperature of the heat treatment is higher or the holding time is longer. Particularly, the crystals can be effectively coarsened by increasing the temperature.

(Shape Processing Process)

Next, the base material after the heat treatment is processed to the shape of the timepiece part. The processing method may be any one of pressing, forging, mechanical processing, or the like. If the heat treatment process is performed after the shape processing process, bending due to the heat treatment occurs, and the accuracy of the dimensions of the timepiece part is decreased. Moreover, if the shape processing process is performed after the etching process described below, the metallic luster provided by the etching is damaged. Therefore, due to the fact that the shape processing process is performed after the heat treatment process and before the etching process, the accuracy of the dimensions of the timepiece part is secured, and it is possible to ensure the external appearance.

(Etching Process)

In the above-described heat treatment process, the crystals are coarsened to provide the metallic luster. However, since the size of the crystals is limited for suppressing the variation in hardness, the metallic luster cannot be sufficiently obtained. Therefore, next, etching is performed on the surface of the timepiece part after the shape processing process, and a sufficient metallic luster is provided on the surface of the timepiece part.

Figure 5A:
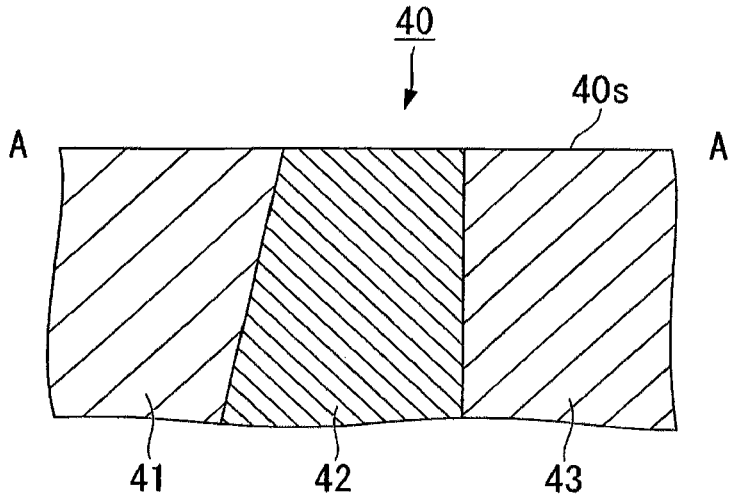
FIGS. 5A and 5B are cross-sectional views taken along a line A-A of FIG. 4.
Figure 5B:
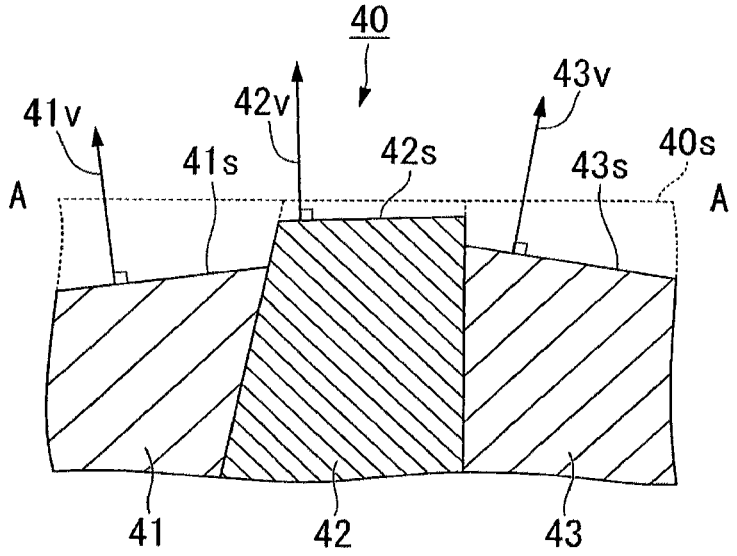

FIGS. 5A and 5B are cross-sectional views taken along a line A-A of FIG. 4, FIG. 5A is a state before the etching, and FIG. 5B is a state after the etching.

As shown in FIG. 5A, a timepiece part 40 includes a plurality of crystals 41 to 43 which are coarsened in the heat treatment process, and a surface 40*s* of the timepiece part 40 is processed to be flattened in the shape processing process. In the etching process, the timepiece part 40 is deposited in an etching solution, and wet etching is performed with respect to the surface 40*s* of the timepiece part 40.

The etching is performed with pre-treatment and post-treatment. In the pre-treatment, the timepiece part is deposited in an aqueous solution of 0.3 to 7 wt % of fluorinated acid (HF). In the post-treatment, the timepiece part is deposited in an aqueous solution of 0.3 to 3 wt % of fluorinated acid (HF), 0.1 to 10 wt % of nitric acid ($HNO_3$), and 5 to 35 wt % of hydrogen peroxide solution ($H_2O_2$).

As shown in FIG. 5B, the surfaces 41*s* to 43*s* of the crystals 41 to 43 of titanium or the like are mirror-finished by etching. In addition, since each crystal 41 to 43 has a crystal orientation, the surfaces 41*s* to 43*s* after etching become an inclined surface with respect to the surface 40*s* before etching. Since each crystal 41 to 43 is grown around different nucleuses, the crystal orientations are different from one another. Therefore, the etching rates of each crystal 41 to 43 are different from one another, and the inclination directions and the inclination angles of the surfaces 41*s* to 43*s* after the etching are different from one another. That is, the normal directions 41*v* to 43*v* of the surfaces 41*s* to 43*s* after the etching are different from one another. Thereby, light incident to the surface of the timepiece part 40 is reflected in different directions on the surfaces 41*s* to 43*s* of each crystal 41 to 43. As a result, a metallic luster which shines brilliantly is provided on the surface of the timepiece part 40.

Moreover, the dimensional error which is allowable to the timepiece part 40 is about 50 μm. Thereby, the etching time is set so that the difference between the crystal having a maximum etching amount and the crystal having a minimum etching amount is 50 μm or less. In addition, since the dimensional error previously exists at the state before the etching process (after the shape processing process), it is preferable that the difference of the etching amount is suppressed to 10 to 30 μm or less.

(Anodic Oxidation Process)

Next, anodizing is performed on the surface of the timepiece part, and corrosion resistance is provided. Specifically, the timepiece part 40 is deposited in an electrolytic solution and connected to an anode, and a voltage is applied between the anode and a cathode to cause an electric current to flow between the anode and cathode. Thereby, water is electrolyzed, and an oxide film of titanium or the like is formed on the surface of the timepiece part 40. Here, by adjusting the applied voltage, the surface of the timepiece part 40 can be variously colored. Thus, a metallic luster which shines brilliantly with a specific hue is provided on the surface of the timepiece part 40.

As described above, the manufacturing method of the timepiece part according to the present embodiment includes a heat treatment process that heat-treats titanium or the like and coarsens a plurality of crystals 41 to 43 of titanium or the like, and an etching process that etches titanium or the like, mirror-finishes the surfaces 41*s* to 43*s* of each crystal 41 to 43, and makes the normal directions 41*v* to 43*v* of the surfaces 41*s* to 43*s* of each crystal 41 to 43 to be different from one another.

Since the crystals are coarsened by the heat treatment process, a metallic luster is provided on the surface of the timepiece part. In addition, in a case where the metallic luster is insufficient due to the fact that coarsening of the crystals is limited for suppressing a variation in the hardness of the timepiece part, the surfaces of each crystal are mirror-finished in the etching process, and the normal directions of the surfaces of each crystal are different from one another. Therefore, a metallic luster which shines brilliantly can be provided on the surface of the timepiece part.

The technical scope of the present invention is not limited to the above-described embodiments, and includes those in which various alterations are applied to the above-described embodiments within the range without departing from the gist of the present invention. That is, specific material or layer configuration and the like described in the embodiments are only one example and can be appropriately modified.

For example, the case where the timepiece part is manufactured of titanium or the like is described, but the present invention can be applied to a case where the timepiece part is manufactured of tungsten.

What is claimed is:

1. A timepiece part made of polycrystalline material having a plurality of crystals each having a size of 7 μm or more and 3 mm or less, the crystals at a surface of the timepiece part having mirror-finished surfaces, and the normal directions of the mirror-finished surfaces being different from one another to provide a metallic luster to the timepiece part, wherein the size of the crystals is about one-tenth the size of the timepiece part.

2. A timepiece part according to claim 1, wherein the polycrystalline material is titanium, titanium alloy, or tungsten.

3. A timepiece part according to claim 2, wherein the mirror-finished surfaces are anodized to provide corrosion resistance.

4. A timepiece part according to claim 1, wherein the mirror-finished surfaces are anodized to provide corrosion resistance.

5. A timepiece part according to claim 1, wherein the timepiece part is a balance staff.

6. A timepiece part according to claim 1, wherein the timepiece part is an oscillating weight.

7. A timepiece part according to claim 1, wherein the timepiece part is a dial.

* * * * *